US009194348B2

(12) United States Patent
Di et al.

(10) Patent No.: US 9,194,348 B2
(45) Date of Patent: Nov. 24, 2015

(54) FUEL INJECTOR TAPPET THREAD RETENTION

(75) Inventors: JianYing Di, Peoria, IL (US); FengJuan Zhao, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 713 days.

(21) Appl. No.: 13/528,020

(22) Filed: Jun. 20, 2012

(65) Prior Publication Data

US 2013/0341434 A1 Dec. 26, 2013

(51) Int. Cl.

| | |
|---|---|
| ***B05B 15/08*** | (2006.01) |
| ***F02M 57/02*** | (2006.01) |
| ***F02M 59/10*** | (2006.01) |

(52) U.S. Cl.

CPC ..... *F02M 57/023* (2013.01); *F02M 59/102* (2013.01); *Y10T 137/0402* (2015.04)

(58) Field of Classification Search

CPC ..... F02M 59/102

See application file for complete search history.

(56) References Cited

U.S. PATENT DOCUMENTS

| | | | | |
|---|---|---|---|---|
| 1,905,888 | A * | 4/1933 | Berry | 123/90.54 |
| 2,559,364 | A * | 7/1951 | Mashinter | 239/90 |
| 2,644,437 | A * | 7/1953 | Johnson | 123/90.54 |
| 2,657,895 | A * | 11/1953 | Huber et al. | 251/347 |
| 3,719,377 | A | 3/1973 | Schultz et al. | |
| 6,209,798 | B1 | 4/2001 | Martin et al. | |
| 6,684,859 | B2 | 2/2004 | Bredesen et al. | |
| 7,422,400 | B2 | 9/2008 | Hsieh | |
| 7,644,694 | B2 | 1/2010 | Hanold et al. | |
| 2009/0250531 | A1 * | 10/2009 | Rogers et al. | 239/88 |

FOREIGN PATENT DOCUMENTS

WO 2011/003979 A1 1/2011

* cited by examiner

*Primary Examiner* — Len Tran
*Assistant Examiner* — Adam J Rogers

(57) ABSTRACT

A cam actuated fuel injector is assembled by engaging an internal thread of a tappet with an external thread of an injector body. The tappet is then rotated with respect to the injector body about a centerline until the internal thread disengages the external thread so that the tappet is then slidable along the centerline. The tappet is biased toward a pre-installation position in which the external thread contacts the internal thread. After installation, the respective internal and external threads guide the sliding movement interaction between the tappet and the injector body when the fuel injector is operational.

10 Claims, 4 Drawing Sheets

FUEL INJECTOR TAPPET THREAD RETENTION

TECHNICAL FIELD

The present disclosure relates generally to tappet retention mechanisms for cam actuated fuel injectors, and more particularly to a thread retention strategy for preventing a tappet from separating from an injector body during the pre-installation handling.

BACKGROUND

One class of fuel injectors are mechanically actuated via rotation of a cam shaft. As a cam lob rotates, a tappet is driven downward to push a plunger within the fuel injector to pressurize fuel for an injection event. After the cam lobe passes, a mechanical spring biases the tappet toward a retracted position to follow the cam surface as the cam continues to rotate. Prior to installation in the engine, there typically must be some means provided for preventing the biasing spring from causing the tappet to separate from the injector body during pre-installation handling. Known tappet retention strategies may utilize a pin such as that described in co-owned U.S. Pat. No. 6,209,798, or possibly a snap ring. Although these strategies have worked well, there remains room for improvement, particularly with regard to ease of assembly, robust operation over a long service life, and fuel leakage from the fuel injector around the tappet.

The present disclosure is directed toward one or more of the problems set forth above.

SUMMARY

In one aspect, a fuel injector includes an injector body with an external thread about a centerline. A tappet, which has an internal thread that matches the external thread, is slidably mounted on the injector body. The tappet is movable with respect to the injector body along the centerline between a pre-installation position, a retracted operational position and an advanced operational position. The internal thread is in contact with the external thread at the pre-installation position, but is out of contact at the refracted operational position and the advanced operational position. A spring is operably positioned to bias the tappet toward the pre-installation position. The tappet is constrained to move between the retracted operational position and the advanced operational position when installed in an engine. The contact interaction between the internal thread and the external thread at the pre-installation position maintains the tappet assembled to the injector body during pre-installation handling.

In another aspect, a method of assembling a fuel system includes assembling a fuel injector by engaging an internal thread of a tappet with an external thread of an injector body, and rotating the tappet with respect to the injector body about a centerline. The rotating step is continued until the internal thread disengages the external thread so that the tappet is slidable along the centerline. The tappet is biased toward a pre-installation position at which the external thread contacts the internal thread.

DETAILED DESCRIPTION

Figure 1:
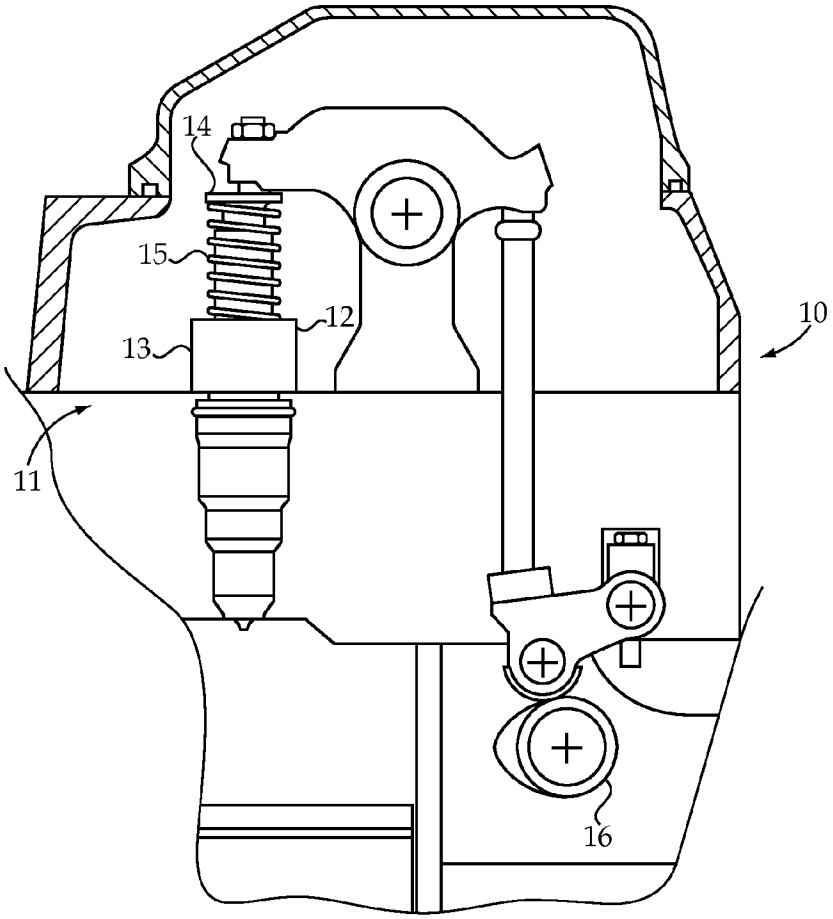
FIG. 1 is a sectioned side view of an engine according to one aspect of the present disclosure.
Figure 4:
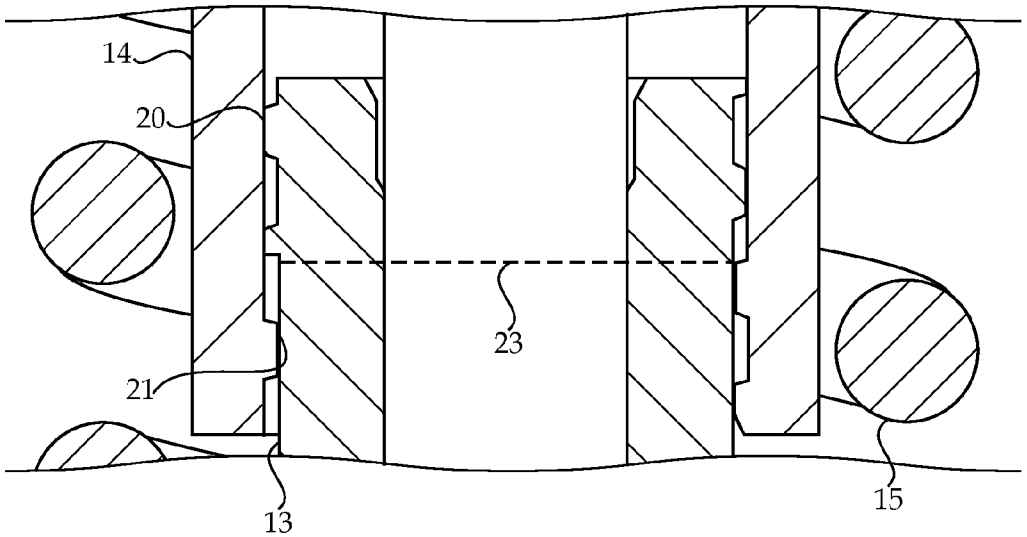
FIG. 4 is an enlarged view of the thread area from the fuel injector shown in FIG. 3.

Referring to FIG. 1, a sectioned view through an engine 10 shows a cam actuated fuel system 11 in which each fuel injector 12 is positioned for direct injection into individual engine cylinders responsive to rotation of cam 16. In particular, when cam 16 rotates, a tappet 14 of fuel injector 12 is driven downward against the biasing action of spring 15 to compress fuel within fuel injector 12 to commence an injection event. Tappet 14 is biased to retract by spring 15 to follow the contour of the lobe for cam 16. During operation of engine 10 and fuel system 11, tappet 14 will move with respect to injector body 13 between a refracted operational position associated with the circular portion of cam lobe 16 and an advanced operational position corresponding to the peak of the lobe for cam 16. Prior to installation in fuel system 11, spring 15 will tend to push tappet 14 to separate from injector body 13 during pre-installation handling unless some retention strategy is present. The present disclosure teaches a new tappet retention strategy that exploits an interaction between internal and external threads 20, 21 on the tappet 14 and injector body 13, respectively, without interfering with the operation of fuel injector 12 after installation as shown in FIG. 1.

Figure 2:
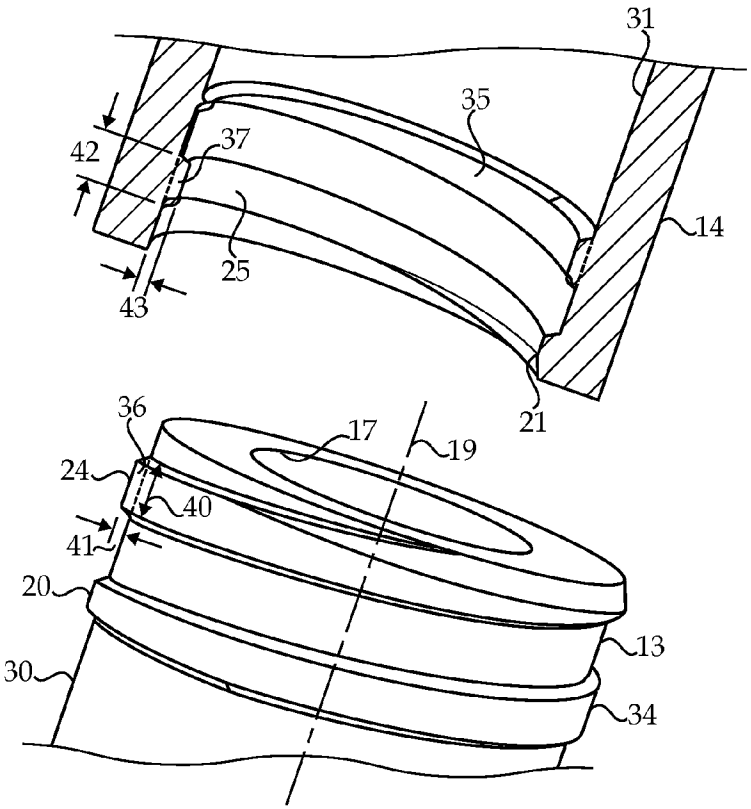
FIG. 2 is a partially sectioned perspective view of a tappet prior to engagement with an injector body according to another aspect of the present disclosure.
Figure 3:
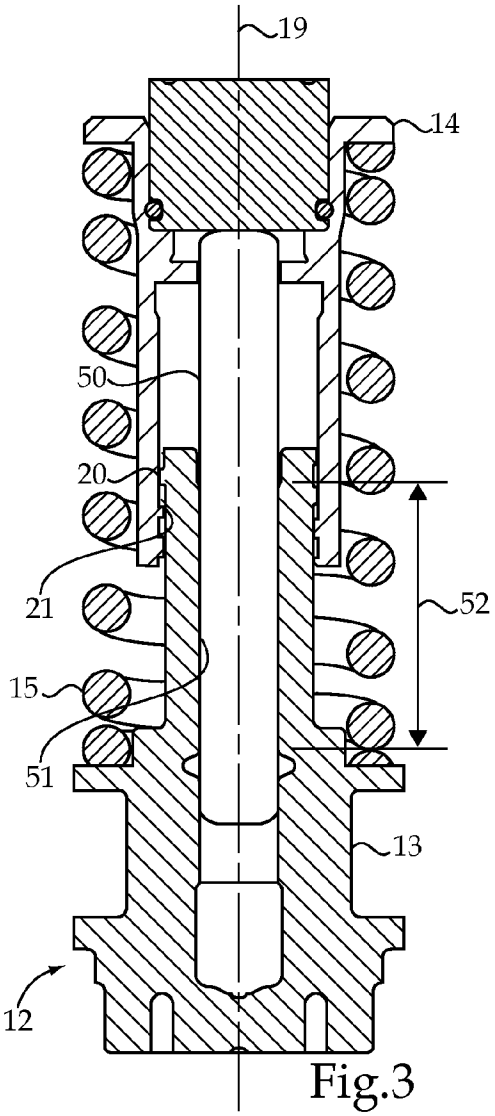
FIG. 3 is a partial sectioned front view of a fuel injector according to the present disclosure when the tappet is at a pre-installation position.
Figure 6:
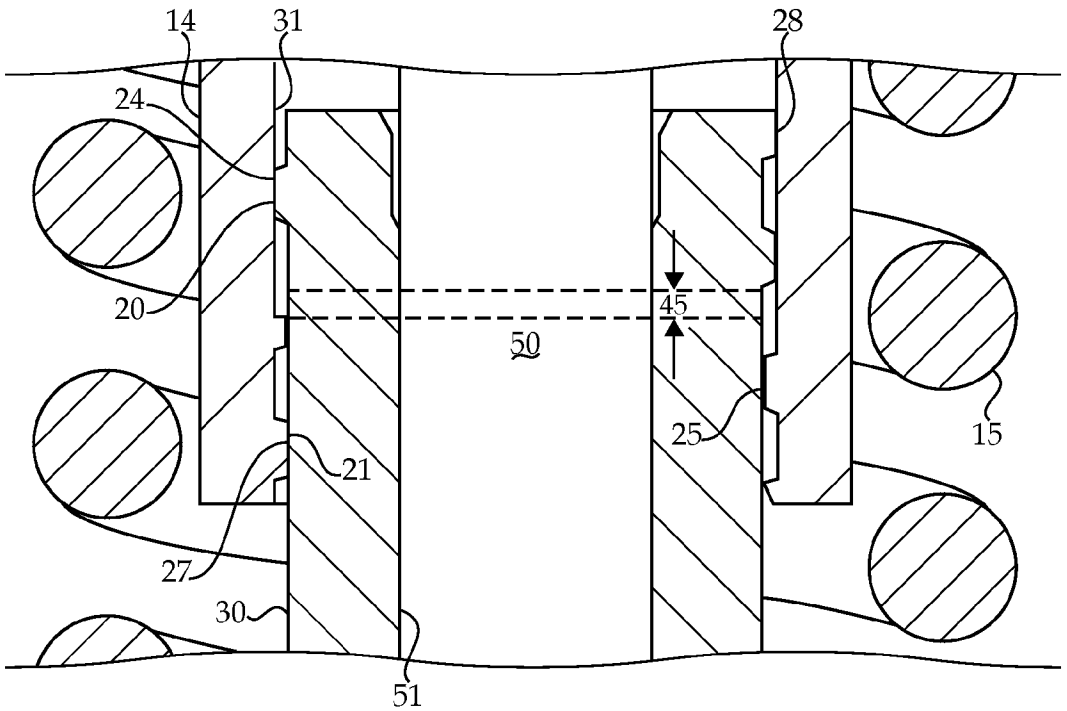
FIG. 6 is an enlarged front sectioned view of the thread area of the fuel injector of FIG. 5.
Figure 5:
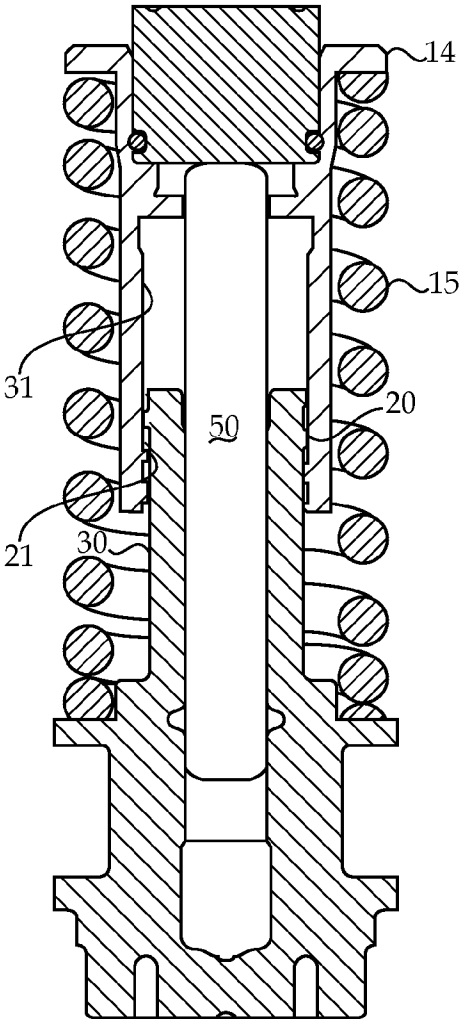
FIG. 5 is a partial sectioned front view of the fuel injector from FIG. 3 when the tappet is at a retracted operational position.
Figure 7:
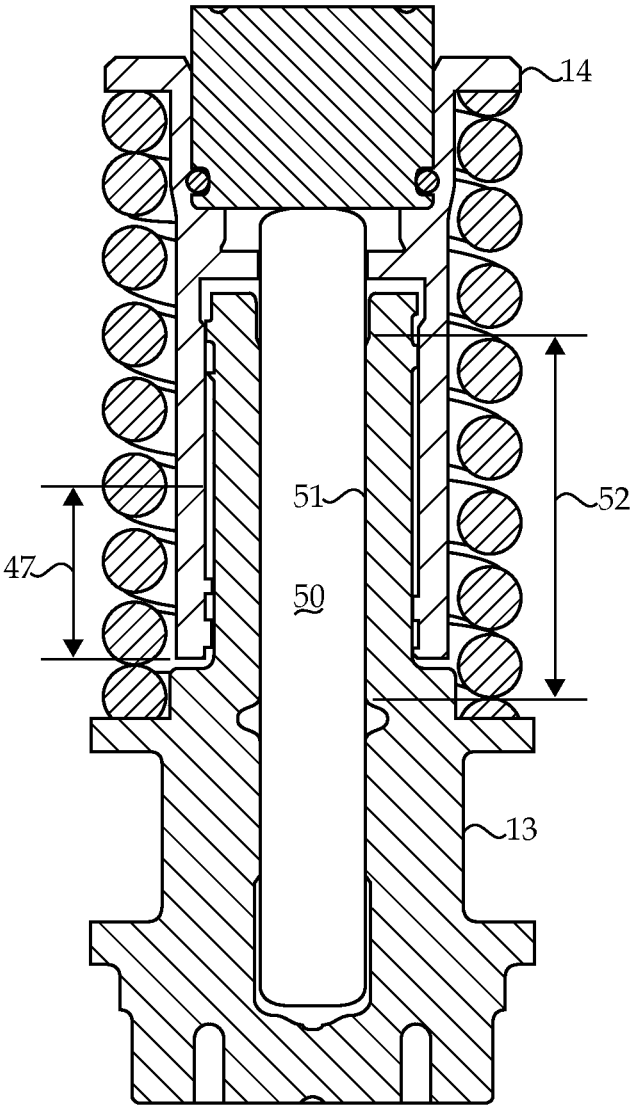
FIG. 7 is a partial front sectioned view of the fuel injector of FIG. 3 when the tappet is at an advanced operational position.

Referring in addition to FIGS. 2-7, injector body 13 includes an external thread 20 about a centerline 19. Tappet 14 includes an internal thread 21 that matches the external thread 20. FIG. 2 shows tappet 14 just prior to being connected to injector body 13. The fuel injector is assembled by engaging the internal thread 21 of tappet 14 with the external thread 20 of injector body 13, and rotating tappet 14 with respect to injector body 13 about centerline 19. Assembly is completed when the internal thread 21 disengages from external thread 20 so that the tappet 14 is then slidably mounted on injector body 13 as shown in FIG. 3. After being assembled, tappet 14 is movable with respect to injector body 13 along centerline 19 between a pre-installation position as shown in FIG. 3, a refracted operational position as shown in FIGS. 1 and 5, and an advanced operational position as shown in FIG. 7.

At the pre-installation position, the internal thread 21 is in contact with the external thread 20 along a planar contact line 23. The contact is planar because the end of each thread is truncated into a plane perpendicular to centerline 19. If the threads were not truncated the contact might be helical, which would also fall within the scope of the present disclosure. The internal thread 21 and the external thread 20 are out of contact with each other throughout movement between the retracted operational position as shown in FIG. 5 and the advanced operational position as shown in FIG. 7. As discussed earlier, spring 15 is operably positioned to bias the tappet 14 toward the pre-installation position. Thus, after installation in engine 10, tappet 14 is constrained to move between the retracted operational position and the advanced operational position. In addition, during pre-installation handling, the planar contact interaction 23 between the internal thread 21 and the external thread 20 maintains the tappet 14 assembled to the injector body 13.

Apart from retaining the tappet 14 to the injector body 13 during pre-installation handling, the threads 20, 21 also serve to guide movement of the tappet by a first guide clearance 28 between a ridge top 24 of the external thread 20 and a cylindrical guide wall 31 of tappet 14, and a second guide clearance 27 between a ridge top 25 of internal thread 21 and a cylindrical guide wall 30 of injector body 13, as best shown in FIG. 6. This guiding clearance interaction is facilitated by the ridge top 24 of external thread 20 defining a helical band portion of a first cylinder 34 as best shown in FIG. 2. Likewise, the ridge top 25 of internal thread 21 also defines a helical band portion of a second cylinder 35.

A cross section of the external thread 20 has a shape of a first trapezoid 36. Likewise, a cross section of the internal thread 21 has a shape of a second trapezoid 37. The first trapezoid 36 has a width 40 that is greater than a height 41. Likewise, the second trapezoid 37 may have a width 42 greater than a height 43. As best shown in FIG. 6, the widths 40, 42 of the first trapezoid and the second trapezoid are greater than a distance 45 between the pre-installation position and the retracted position. In one embodiment, each of the external thread 20 and the internal thread 21 encircle centerline 19 between one and two turns. Because the retention strategy of the present disclosure is entirely located on the outer surface of the injector body 13, a plunger 50 that is received in a plunger bore 17 can have a guide clearance 51 that has a length 52 along centerline line 19 that is greater than a distance 47 between the retracted operational position and the advanced operational position as best shown in FIG. 7. This aspect helps to inhibit migration of fuel up along the plunger guide clearance 51 and eventually out of fuel injector 12 between tappet 14 and injector body 13.

INDUSTRIAL APPLICABILITY

The present disclosure finds potential application in any cam actuated fuel injector. The present disclosure finds specific application in any fuel injector that includes a tappet that is biased toward a pre-installation position with respect to an injector body by a spring. In addition, the present disclosure finds potential application in any fuel injector where the spring would tend to separate the tappet from the injector body during pre-installation handling. Finally, the present disclosure finds potential application to cam actuated fuel injectors where the retention strategy also serves to guide sliding movement of the tappet after the fuel injector is installed in an engine.

Prior to installation in an engine, the tappet 14 will be prevented from being pushed off of, or separated from, injector body 13 by spring 15 due to the planar contact line 23 between internal thread 21 and external thread 20. When installed in engine 10, the tappet 14 will move distance 45 from the pre-installation position to the retracted operational position at which the external thread 20 is no longer in contact with internal thread 21. When in operation, the tappet will slide along centerline 19 on injector body 13. The first and second guide clearances 27 and 28 help to guide this motion with respective first and second helical bands 34 and 35. In a preferred embodiment, the tappet 14 is initially assembled to injector body 13 by rotating around centerline 19 between one and two turns. Nevertheless, those skilled in the art will appreciate that additional turns, and maybe less than one turn, would also fall within the scope of the present disclosure. In addition, a multi-thread design would also fall within the scope of the present disclosure. Two or more partial or full threads would also fall within the scope of the present disclosure.

By locating the retention feature and the tappet guiding features on the outside of the injector body 13, a longer guide clearance 51 can be provided between plunger 50 and injector body 13 to help seal against leakage of fuel from between tappet 14 and injector body 13 with repeated movement of the plunger sliding in injector body 13 responsive to rotation of cam 16 (FIG. 1).

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A fuel injector comprising:

an injector body with an external thread about a centerline;

a tappet with an internal thread that matches the external thread and being slidably mounted on the injector body, the tappet being movable with respect to the injector body along the centerline between a pre-installation position, a retracted operational position, and an advanced operational position, the internal thread being in contact with the external thread at the pre-installation position, but the internal thread being out of contact with the external thread at the retracted operational position and the advanced operational position; and a spring operably positioned to bias the tappet toward the pre-installation position, wherein the tappet is constrained to move between the retracted operational position and the advanced operational position when installed in an engine, and wherein a contact interaction between the internal thread and the external thread at the pre-installation position maintains the tappet assembled to the injector body during pre-installation handling.

2. The fuel injector of claim 1 wherein a ridge top of the external thread has a guide clearance with respect to a cylindrical guide wall of the tappet, and a ridge top of the internal thread has a guide clearance with respect to a cylindrical guide wall of the injector body.

3. The fuel injector of claim 2 wherein the ridge top of the external thread defines a helical band portion of a first cylinder, and the ridge top of the internal thread defines a helical band portion of a second cylinder.

4. The fuel injector of claim 1 wherein a cross section of the external thread has a shape of a first trapezoid, and a cross section of the internal thread has a shape of a second trapezoid.

5. The fuel injector of claim 4 wherein the first trapezoid has a width greater than a height of the first trapezoid, and the second trapezoid has a width greater than a height of the second trapezoid.

6. The fuel injector of claim 5 wherein the width of the first trapezoid and the width of the second trapezoid are greater than a distance between the pre-installation position and the refracted operational position.

7. The fuel injector of claim 1 wherein each of the external thread and the internal thread encircle the centerline between one and two turns.

8. The fuel injector of claim 1 further comprising a plunger slidable in the injector body responsive to movement of the tappet, wherein the plunger has a guide clearance with the injector body, the guide clearance having a length along the centerline that is greater than a distance between the retracted operational position and the advanced operational position.

9. The fuel injector of claim 1 further comprising a plunger slidable in the injector body responsive to movement of the tappet, wherein a ridge top of the external thread has a guide clearance with respect to a cylindrical guide wall of the tappet, a ridge top of the internal thread has a guide clearance with respect to a cylindrical guide wall of the injector body, the ridge top of the external thread defines a helical band portion of a first cylinder, the ridge top of the internal thread defines a helical band portion of a second cylinder, a cross section of the external thread has a shape of a first trapezoid, a cross section of the internal thread has a shape of a second trapezoid, the first trapezoid has a width greater than a height of the first trapezoid, the second trapezoid has a width greater than a height of the second trapezoid, and the plunger has a guide clearance with the injector body, the guide clearance having a length along the centerline that is greater than a distance between the retracted operational position and the advanced operational position.

10. The fuel injector of claim 9 wherein the width of the first trapezoid and the width of the second trapezoid are greater than a distance between the pre-installation position and the retracted operational position, and each of the external thread and the internal thread encircle the centerline between one and two turns.

* * * * *